US010001339B1

(12) United States Patent
Huang

(10) Patent No.: US 10,001,339 B1
(45) Date of Patent: Jun. 19, 2018

(54) TOY GUN BULLET CONTAINER STRUCTURE

(71) Applicant: KIEN WELL TOY INDUSTRIAL CO., LTD., New Taipei (TW)

(72) Inventor: Shun-Chi Huang, New Taipei (TW)

(73) Assignee: KIEN WELL TOY INDUSTRIAL CO., LTD., New Taipei (TW)

( * ) Notice: Subject to any disclaimer, the term of this patent is extended or adjusted under 35 U.S.C. 154(b) by 0 days. days.

(21) Appl. No.: 15/430,546

(22) Filed: Feb. 13, 2017

(30) Foreign Application Priority Data

Dec. 9, 2016 (TW) ..... 105218849 U

(51) Int. Cl.

| | |
|---|---|
| ***F41B 11/00*** | (2013.01) |
| ***F41B 7/00*** | (2006.01) |
| ***F41B 7/08*** | (2006.01) |
| ***F41B 11/54*** | (2013.01) |

(52) U.S. Cl.
CPC ..... *F41B 7/006* (2013.01); *F41B 7/003* (2013.01); *F41B 7/08* (2013.01); *F41B 11/54* (2013.01)

(58) Field of Classification Search
CPC ..... F41B 11/50; F41B 11/54
See application file for complete search history.

(56) References Cited

U.S. PATENT DOCUMENTS

| | | | | |
|---|---|---|---|---|
| 4,986,251 | A * | 1/1991 | Lilley | F41B 11/55 124/48 |
| 5,150,701 | A * | 9/1992 | Wackrow | F41B 11/57 124/48 |
| 5,522,374 | A * | 6/1996 | Clayton | F41B 11/54 124/48 |
| 6,470,871 | B2 * | 10/2002 | Casas-Salva | F41B 11/54 124/48 |
| 6,796,300 | B2 * | 9/2004 | Petrosyan | F41B 11/55 124/48 |
| 8,839,706 | B1 * | 9/2014 | Macy | F41B 11/54 124/45 |
| 2006/0042613 | A1 * | 3/2006 | Hu | F41B 11/54 124/48 |

* cited by examiner

*Primary Examiner* — John Ricci
(74) *Attorney, Agent, or Firm* — Leong C. Lei

(57) ABSTRACT

An improved toy gun bullet container structure includes a bullet container device, which is selectively and movable mounted in a magazine, a receiving space, which is defined in the bullet container device, and a plurality of bullet compartments, which are arranged in the receiving space in a manner of being free to rotate. The bullet compartments each receive and hold therein a plurality of bullets. The magazine is can be mounted and removed so as to achieve imitation of a genuine device. When one of the bullet compartments runs out of bullets, the magazine can be first removed and the bullet container device rotated to switch the other one of the bullet compartments to the position for shooting. When all the bullet compartments run of bullets, the bullet container device can be detached from the magazine for reloading of bullets.

4 Claims, 9 Drawing Sheets

TOY GUN BULLET CONTAINER STRUCTURE

(a) TECHNICAL FIELD OF THE INVENTION

The present invention relates generally to a toy gun bullet container, and more particularly to an improved toy gun bullet container that shows the characteristics of easy and efficient use and high degree of genuineness imitation.

(b) DESCRIPTION OF THE PRIOR ART

The vivid development of tog guns and increasingly improved technology of the related fields bring up various sorts of new ideas.

One of these newly emerging ideas is an improvement concerning bullet loading, which involves a magazine and a known bullet container. The magazine is provided, at one side thereof, with an insertion bar. The magazine comprises an insertion slot that is formed in a middle of a sidewall of the magazine for receiving the insertion of the insertion bar and a plurality of bullet storage spaces circumferentially arranged around the insertion bar for receiving and holding therein bullets. In this way, the bullets may be individually held and retained to eliminate the potential risk of deformation of the bullets and thus making the shooting of the bullets smooth.

It is, however, found in an actual operation that once the bullet container runs out of bullet, it is necessary to first remove the bullet container and place in a fresh one. In addition to a complicated operation that the insertion bar must be exactly aligned with the insertion slot for achieving the desired perpendicular insertion of the insertion bar, the insertion bar or the insertion slot may be shielded and hidden by the magazine or the bullet container so as to make the use and operation inconvenient.

Thus, it is a goal of research and improvement that those devoted in this field must make to provide a solution that overcomes the above-discussed drawbacks and problems of the prior art.

SUMMARY OF THE INVENTION

In view of the above problems, the present invention is made to provide an improved toy gun bullet container that shows the characteristics of easy and efficient use and high degree of genuineness imitation.

The primary objective of the present invention is to achieve genuineness imitation of removal and replacement of magazines.

Another objective of the present invention is to make removal and replacement easy and efficient.

To achieve the above objectives, the present invention comprises a bullet container device, which is selectively and movably mounted in a magazine. At least one receiving space is defined and delimited in the bullet container device to receive a plurality of bullet compartments arranged therein. The bullet compartments are each freely rotatable in the receiving space. The bullet container device comprises at least one mounting opening and at least one elastic mounting piece arranged at one side of the mounting opening. The magazine comprises at least one retaining section selectively insertable into the mounting opening and in retaining engagement with the elastic mounting piece.

In use, the retaining section of the magazine is inserted, through sliding, into the mounting opening so that the present invention can be rotatably mounted to the magazine through the elastic mounting piece. The mounting and removal is easy and efficient.

The magazine with the present invention rotatably mounted thereto is combinable with a toy gun to allow the bullets loaded in one of the bullet compartments that is located at a specific position. When the bullets have all been shot, a user may remove the magazine from the toy gun and rotate the bullet container device to drive the bullet compartments to move, so that one of the bullet compartments containing bullets that have not yet been shot can be moved to the specific position and re-combination with the toy gun can be made for subsequent shooting.

Further, for supplementary loading of bullets into the bullet compartments, the retaining section of the magazine is moved, through sliding, out of the mounting opening to allow for supplementing and reloading bullets. With the above-described techniques, the problems of being inconvenient of use for the prior art bullet compartments can be overcome to achieve advantages of easy and efficient use and high degree of imitation of a genuine device.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

Figure 1:
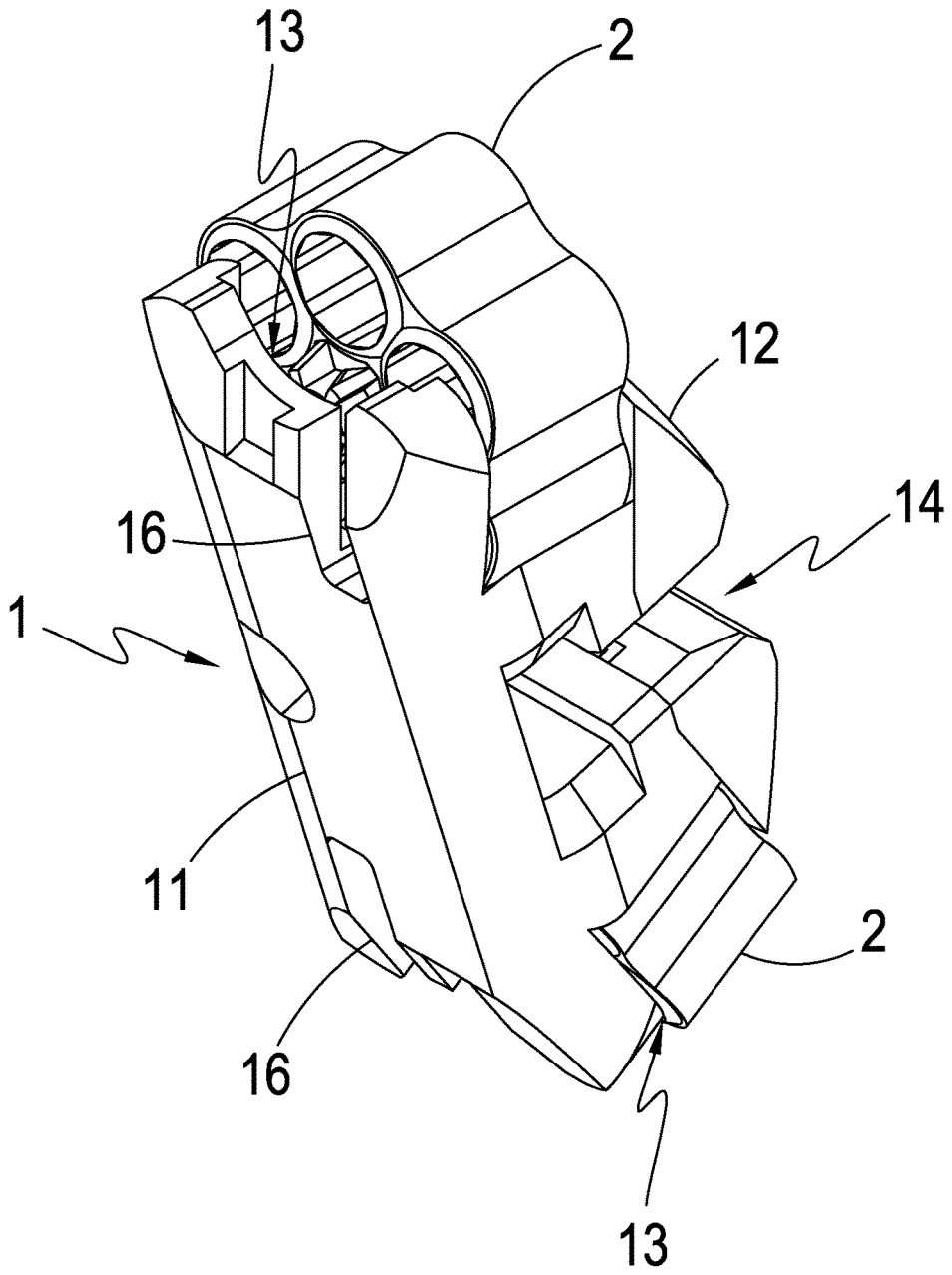
FIG. 1 is a perspective view showing a preferred embodiment of the present invention.
Figure 2:
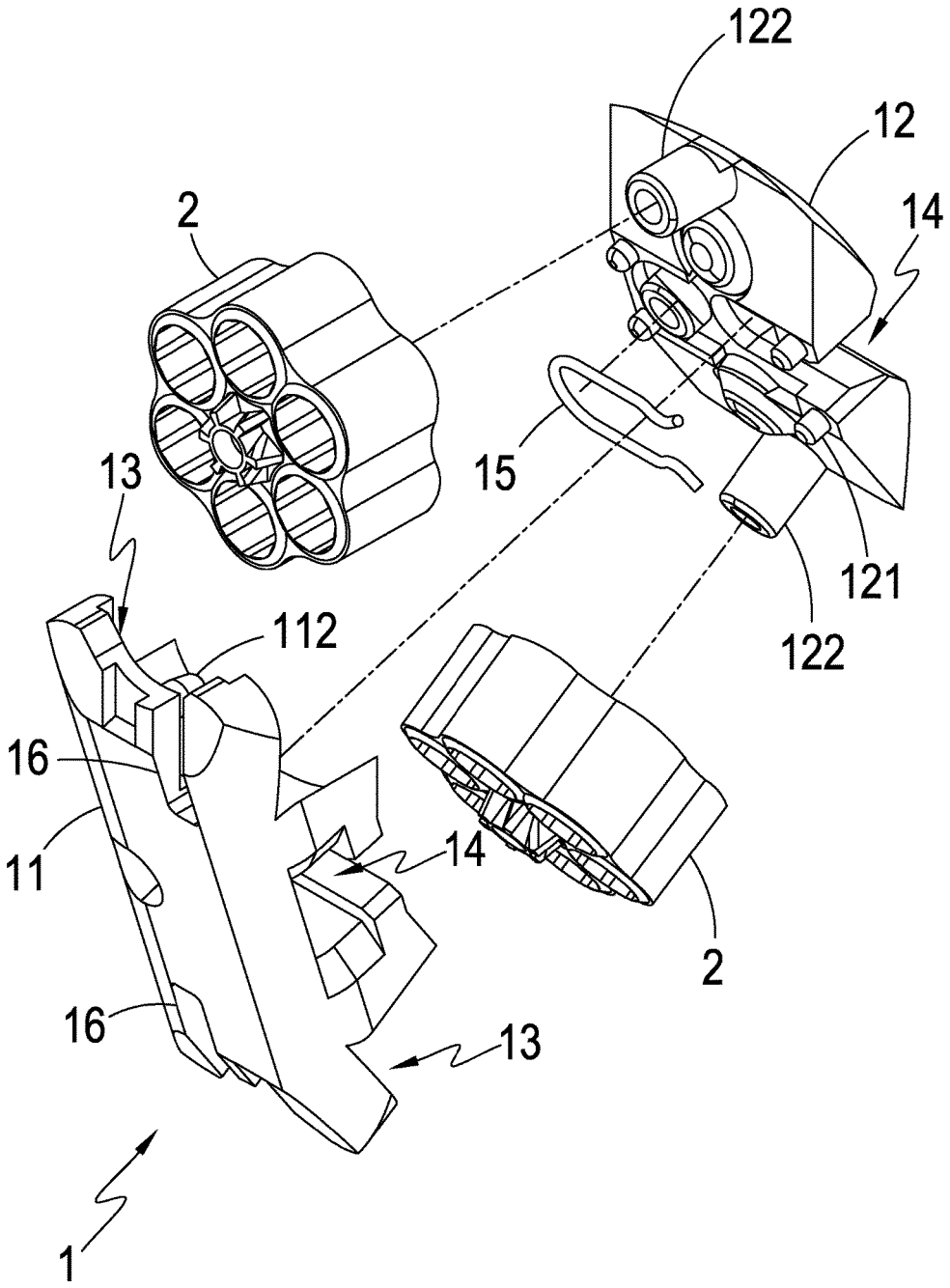
FIG. 2 is an exploded view of the preferred embodiment of the present invention.
Figure 3:
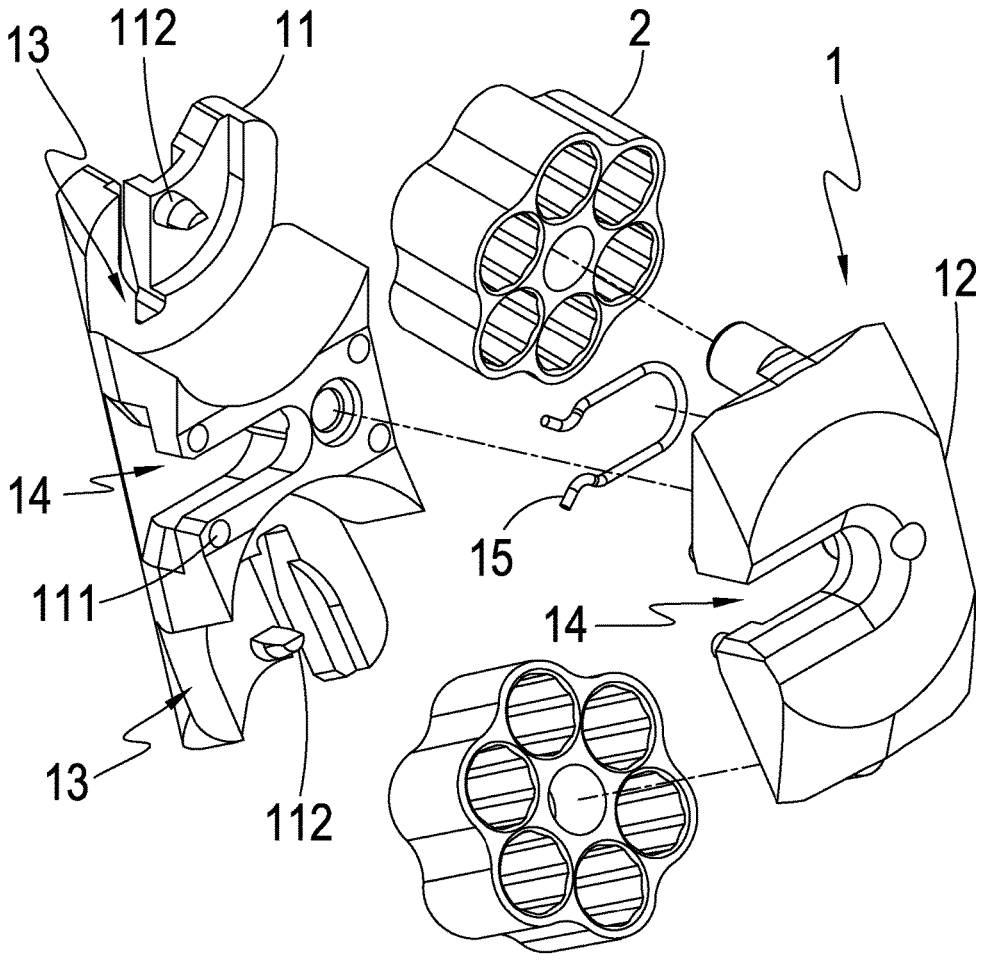
FIG. 3 is another exploded view of the preferred embodiment of the present invention.
Figure 4:
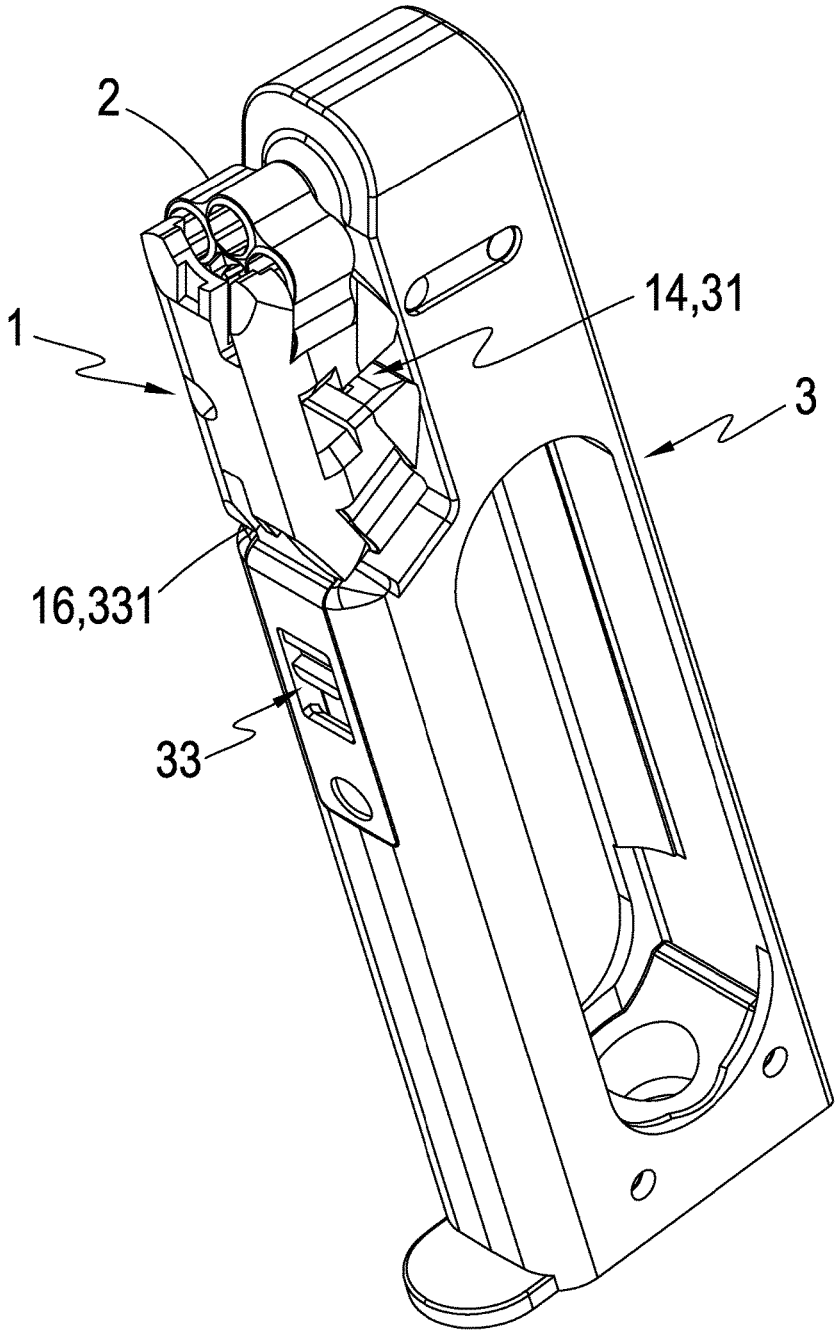
FIG. 4 is a perspective view illustrating an application of the preferred embodiment of the present invention.
Figure 5:
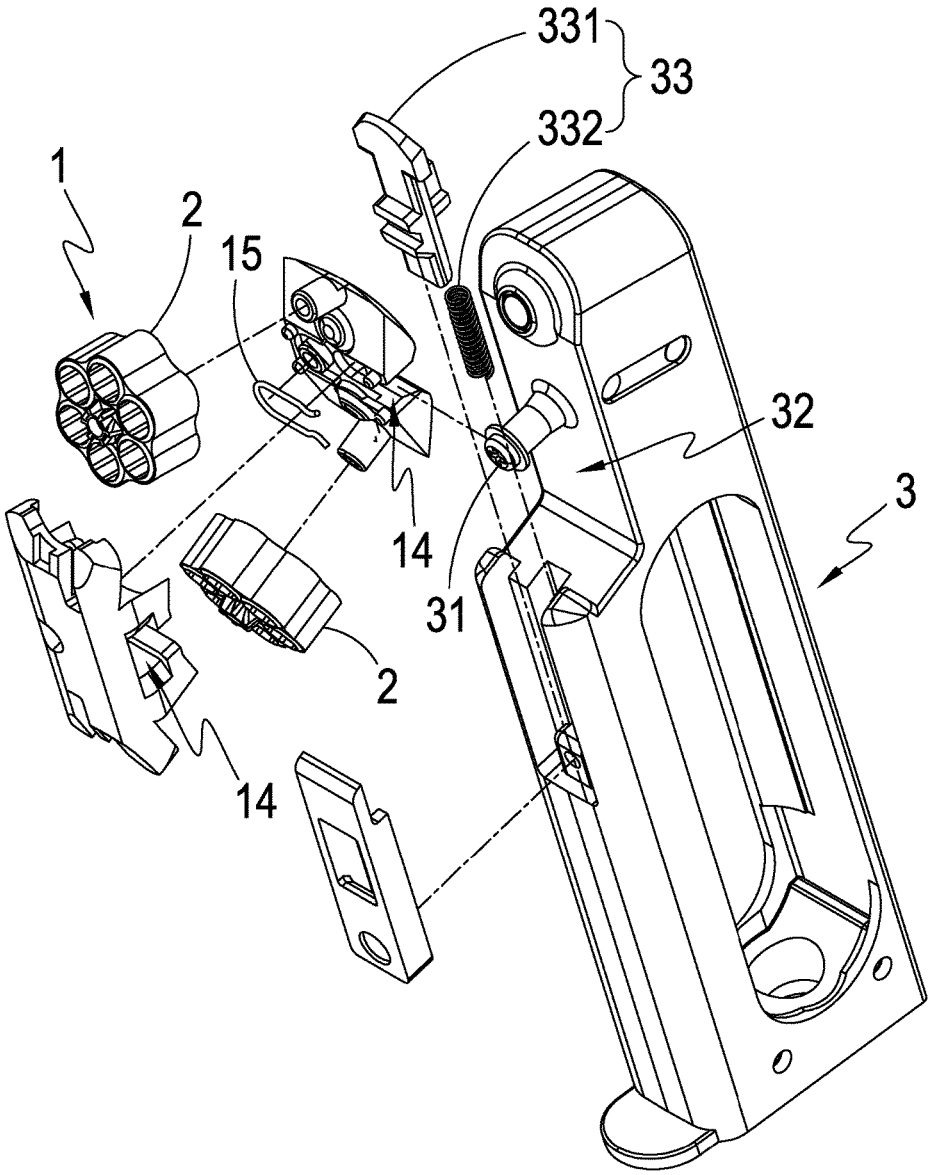
FIG. 5 is an exploded view of the application of the preferred embodiment of the present invention.

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Referring to FIGS. 1-5, which are respectively a perspective view showing a preferred embodiment of the present invention, an exploded view of the preferred embodiment of the present invention, another exploded view of the preferred embodiment of the present invention, a perspective view illustrating an application of the preferred embodiment of the present invention, and an exploded view of the application of the preferred embodiment of the present invention, it is clearly shown in the drawings that the present invention generally comprises a bullet container device 1, at least one receiving space 13, and a plurality of bullet compartments 2. The bullet container device 1 is selectively and movably mounted in a magazine 3. The receiving spaces 13 are defined in the bullet container device 1. The bullet container device 1 comprises at least one first bullet container component 11 and at least one second bullet container component 12 arranged beside the first bullet container component 11. The first bullet container component 11 and the second bullet container component 12 collectively define and delimit the receiving spaces 13. The first bullet container component 11 comprises at least one first coupling section 111, and the second bullet container component 12 comprises at least one second coupling section 121 that corresponds to and is connectable with the first coupling section 111.

The bullet compartments 2 are each arranged in the receiving spaces 13 in a manner of being free to rotate. Each of the bullet compartments 2 receives and holds therein a plurality of bullets. The first bullet container component 11 comprises a plurality of first pivot joint sections 112 respectively in pivotal coupling with the bullet compartments 2. The second bullet container component 12 comprises a plurality of second pivot joint sections 122 respectively in pivotal coupling with the bullet compartments 2. The first pivot joint sections 112 respectively correspond in position to the second pivot joint sections 122.

The bullet container device 1 comprises at least one mounting opening 14 formed in a lateral side thereof and at least one elastic mounting piece 15 arranged at one side of the mounting opening 14. The bullet container device 1 comprises a plurality of alignment sections 16 respectively corresponding, in position, to the bullet compartments 2.

The magazine 3 comprises at least one retaining section 31 that is selectively insertable into the mounting opening 14 and in retaining engagement with the elastic mounting piece 15. The magazine 3 comprises at least one revolving section 32 arranged and defined beside the retaining section 31 to allow for revolving or rotation of the bullet container device 1. The magazine 3 comprises at least one positioning assembly 33 for cooperation with the alignment sections 16 to fix the bullet container device 1. The positioning assembly 33 comprises at least one positioning member 331 selectively engageable with the alignment sections 16 and at least one elastic member 332 arranged at one side of the positioning member 331 to be operable in combination therewith. The above provides just one of feasible examples of the present invention and the feasible examples are not limited to such an example.

Referring to FIGS. 1-9, which are respectively a perspective view showing a preferred embodiment of the present invention, an exploded view of the preferred embodiment of the present invention, another exploded view of the preferred embodiment of the present invention, a perspective view illustrating an application of the preferred embodiment of the present invention, an exploded view of the application of the preferred embodiment of the present invention, a perspective view illustrating a use of the preferred embodiment of the present invention, a perspective view illustrating a shooting operation of the preferred embodiment of the present invention, a perspective view illustrating a revolving operation of the preferred embodiment of the present invention, and a perspective view illustrating a disassembling operation of the preferred embodiment of the present invention, it can be clearly seen from the drawings that to use the present invention, bullets are first loaded into each of the bullet compartments 2. The retaining section 31 of the magazine 3 is inserted, through sliding from a lateral side of the bullet container device 1, into the mounting opening 14, and the positioning assembly 33 is operated at the same time to make the positioning member 331 displace and retract to compress the elastic member 332. The retaining section 31 is put into retaining engagement with the elastic mounting piece 15 by means of the elasticity of the elastic mounting piece. The positioning assembly 33 is then released to allow for position restoration of the elastic member 332, making the positioning member 331 return and insert into the alignment section 16, thereby fixing the present invention in the magazine 3, allowing one of the bullet compartments 2 to be located at a specific position for being ready for shooting. The operation of mounting and fixing is easy and efficient.

Figure 6:
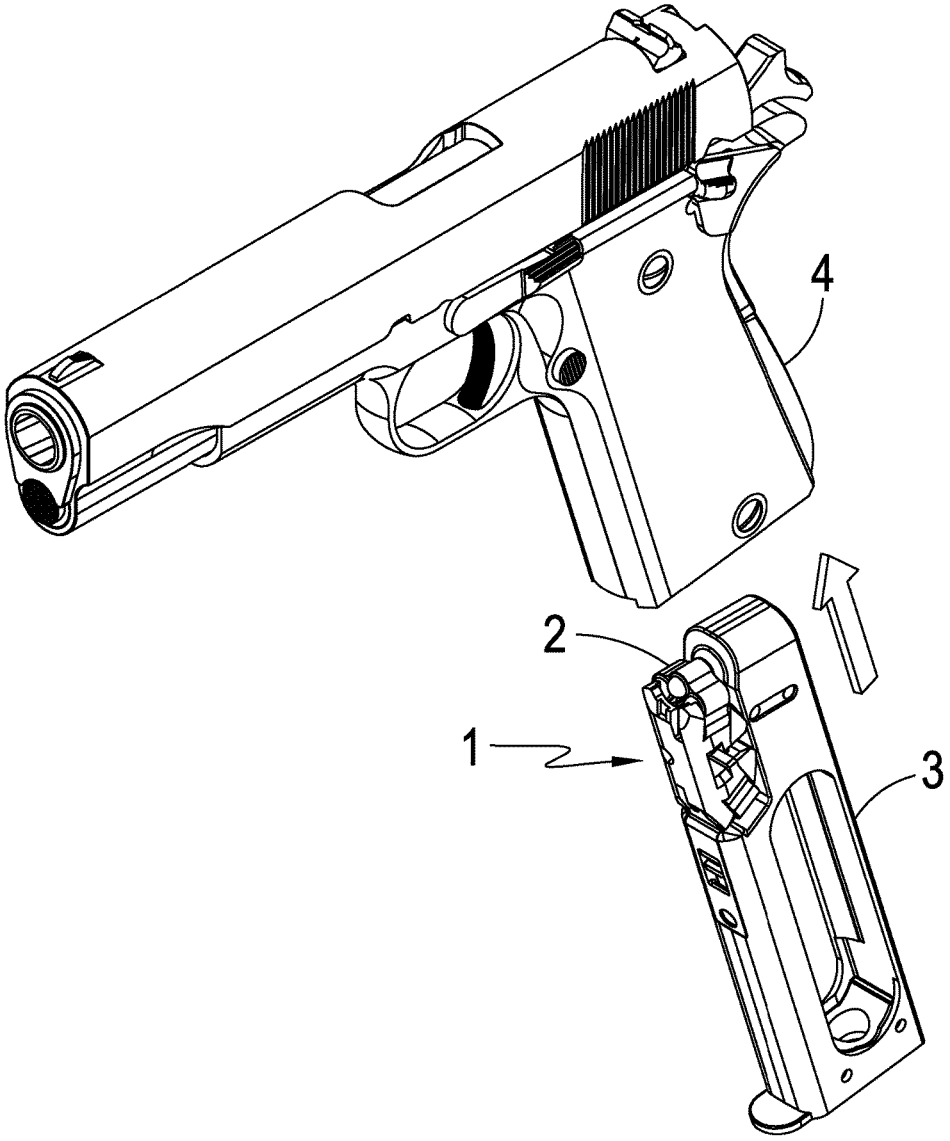
FIG. 6 is a perspective view illustrating a use of the preferred embodiment of the present invention.
Figure 7:
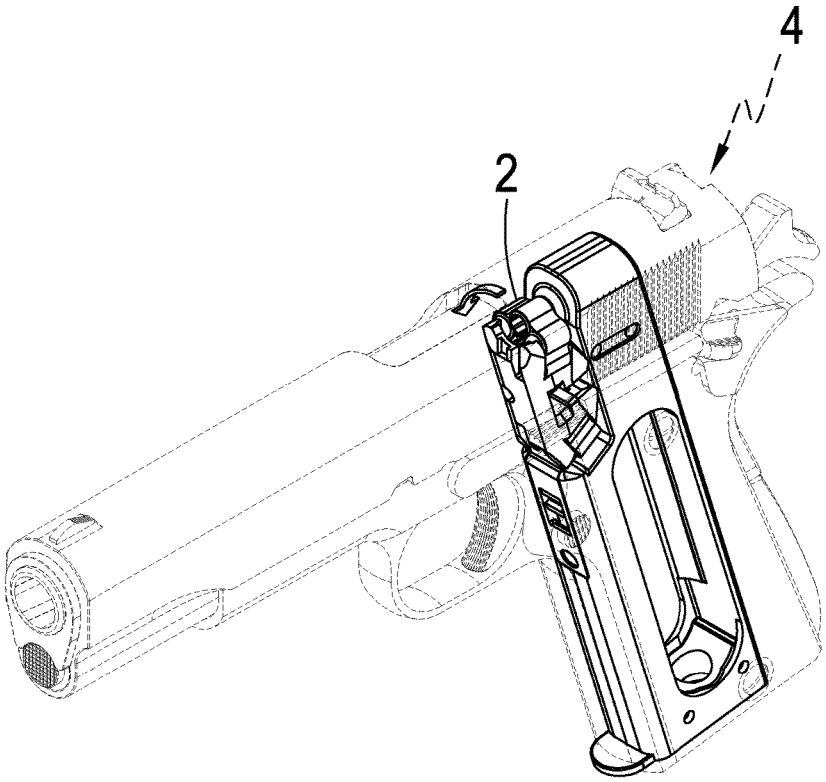
FIG. 7 is a perspective view illustrating a shooting operation of the preferred embodiment of the present invention.

Referring to FIGS. 6 and 7, with the magazine 3 in which the present invention (including the bullet container device 1 and the bullet compartments 2) combined with a toy gun 4, when the toy gun 4 is operated, the one of the bullet compartments 2 that is located at the specific position is driven to revolve and the bullets loaded in this one of the bullet compartments 2 that is located at the specific position are shot. Since the first coupling section 111 and the second coupling section 121 cooperate with each other to fix the first bullet container component 11 and the second bullet container component 12 in position and the first pivot joint section 112 and the second pivot joint sections 122 are respectively coupled to the bullet compartments 2 in a rotatable or pivotal manner, the bullet compartments 2 are allowed to free rotate in the receiving spaces 13.

Figure 8:
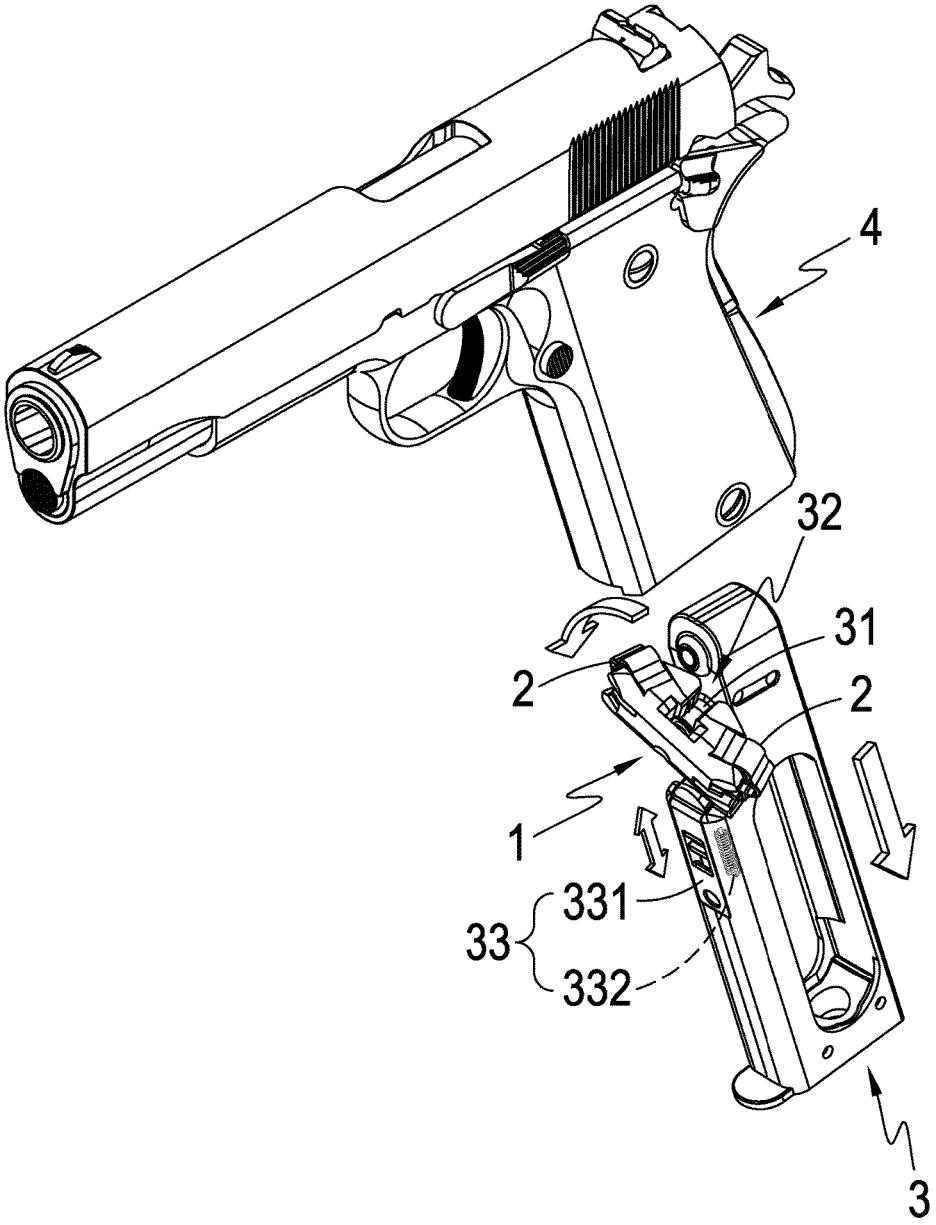
FIG. 8 is a perspective view illustrating a revolving operation of the preferred embodiment of the present invention.

Referring to FIG. 8, when the one of the bullet compartments 2 that is located at the specific position runs out of all the bullets loaded therein, the magazine 3 is withdrawn out of the toy gun 4 and the positioning assembly 33 is operated to have the positioning member 331 displace and retract to compress the elastic member 332, and the bullet container device 1 is rotated about a center defined by the retaining section 31 to drive the bullet compartments 2 to revolve about the revolving section 32 for position change, allowing the one of the bullet compartments 2 that runs out of the bullets thereof to move away from the specific position and the other one of the bullet compartments 2 that contains bullets having not been shot out be set at the specific position for subsequent recombination with the toy gun 4 and shooting. Thus, supplementing bullets can be done in an easy and efficient manner and genuineness imitation can be achieved through mounting and removal of the magazine 3.

Figure 9:
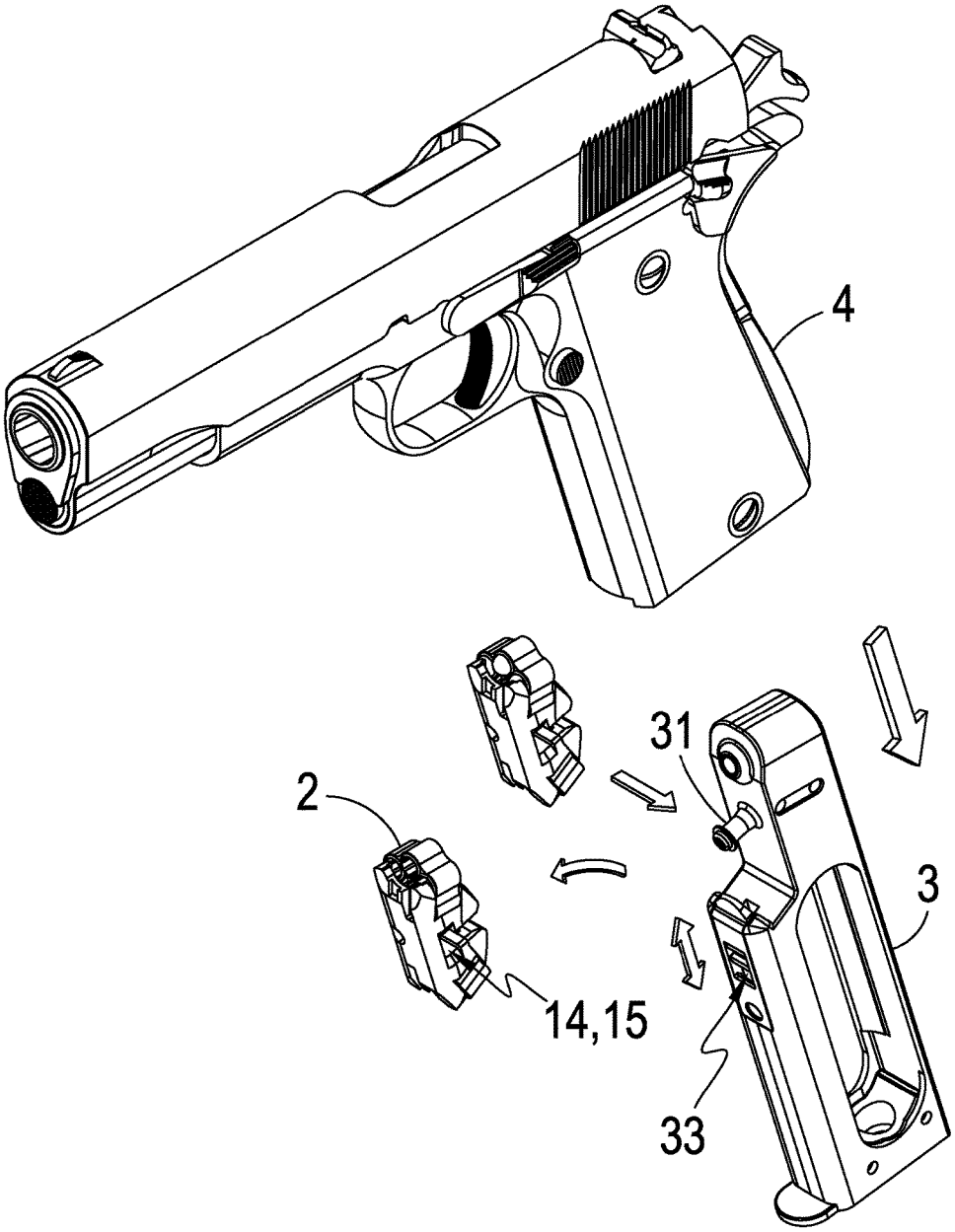
FIG. 9 is a perspective view illustrating a disassembling operation of the preferred embodiment of the present invention.

Referring also to FIG. 9, when the bullet compartments 2 each run out of bullets, the toy gun 4 is separated from the magazine 3 and the positioning assembly 33 is operated to allow the retaining section 31 to slide in a reversed direction to be withdrawn out of the mounting opening 14. The elasticity of the elastic mounting piece 15 allows it to easily separate from the retaining section 31 for replacement. Thus, it is easy and efficient in use.

Thus, the improved toy gun bullet container structure according to the present invention comprises the following features for improving the prior art:

(1) Combinability of the bullet container device 1, the receiving spaces 13, and the bullet compartments 2 with the magazine 3 makes the use of the present invention easy and efficient.

(2) The combinability of the bullet container device 1, the receiving spaces 13, and the bullet compartments 2 with the magazine 3 makes the present invention high in degree of genuineness imitation.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

I claim:

1. An improved toy gun bullet container structure, comprising:

a bullet container device, which is selectively and movable mounted in a magazine;

at least one receiving space, which is defined in the bullet container device; and a plurality of bullet compartments, which are each adapted to receive and hold therein a plurality of bullets, each of the bullet compartments being arranged in the receiving space in a manner of being free to rotate;

wherein the magazine comprises at least one retaining section that is selectively insertable into a mounting opening and in retaining engagement with an elastic mounting piece, and the magazine comprises at least one revolving section arranged and defined beside the retaining section to allow for revolving or rotation of the bullet container device.

2. The improved toy gun bullet container structure according to claim 1, wherein the bullet container device comprises a plurality of alignment sections respectively corresponding, in position, to the bullet compartments.

3. The improved toy gun bullet container structure according to claim 2, wherein the magazine comprises at least one positioning assembly for cooperation with each of the alignment sections to fix the bullet container device.

4. The improved toy gun bullet container structure according to claim 3, wherein the positioning assembly comprises at least one positioning member selectively engageable with the alignment sections and at least one elastic member arranged at one side of the positioning member to be operable in combination therewith.

* * * * *